US006946805B2

(12) United States Patent
Segan et al.

(10) Patent No.: US 6,946,805 B2
(45) Date of Patent: Sep. 20, 2005

(54) CONTROLLER FOR A LIGHT DISPLAY

(75) Inventors: Marc H. Segan, New York, NY (US); Gary Strauss, Mamaroneck, NY (US)

(73) Assignee: M.H. Segan Limited Partnership, Great Barrington, MA (US)

( * ) Notice: Subject to any disclaimer, the term of this patent is extended or adjusted under 35 U.S.C. 154(b) by 0 days.

(21) Appl. No.: 10/683,724

(22) Filed: Oct. 10, 2003

(65) Prior Publication Data

US 2004/0075401 A1 Apr. 22, 2004

Related U.S. Application Data

(60) Provisional application No. 60/417,740, filed on Oct. 10, 2002.

(51) Int. Cl.[7] ..... H05B 37/02; H05B 37/00

(52) U.S. Cl. ..... 315/291; 315/185 R; 315/185 S; 315/200 A; 315/292; 315/312

(58) Field of Search ..... 315/291, 292, 315/312, 185 R, 185 S, 200 A, 241 P, 318, 319; H05B 37/02, 37/00

(56) References Cited

U.S. PATENT DOCUMENTS

| | | | | | |
|---|---|---|---|---|---|
| 4,236,101 | A | | 11/1980 | Luchaco | 315/158 |
| 4,275,335 | A | | 6/1981 | Ishida | 315/241 P |
| 4,772,805 | A | | 9/1988 | Kawata | 307/10 LS |
| 4,890,000 | A | | 12/1989 | Chou et al. | 307/36 |
| 5,006,724 | A | | 4/1991 | Liu | 307/11 |
| 5,629,587 | A | * | 5/1997 | Gray et al. | 315/292 |
| 5,747,940 | A | | 5/1998 | Openiano | 315/185 S |
| 5,929,587 | A | * | 7/1999 | Kang | 318/623 |
| 6,126,298 | A | * | 10/2000 | Wu | 362/252 |
| 6,717,376 | B2 | * | 4/2004 | Lys et al. | 315/292 |
| 6,777,891 | B2 | * | 8/2004 | Lys et al. | 315/291 |
| 2002/0135315 | A1 | * | 9/2002 | Puleo et al. | 315/185 R |

* cited by examiner

*Primary Examiner*—Trinh Vo Dinh
(74) *Attorney, Agent, or Firm*—Cohen, Pontani, Lieberman & Pavane

(57) ABSTRACT

A controller for controlling decorative light displays includes plural outlet ports for providing power to a plurality of decorative light strings. The controller alternately illuminates and dims the different lights strings according to a variety of synchronized patterns.

27 Claims, 7 Drawing Sheets

| TIMER SETTING: | DISPLAY WILL READ: |
|---|---|
| ALWAYS ON–STEADY ILLUMINATION | AO |
| OFF | OF |
| DUSK–ON FOR 2 HOURS | 2H |
| DUSK–ON FOR 4 HOURS | 4H |
| DUSK–ON FOR 6 HOURS | 6H |
| DUSK–ON FOR 8 HOURS | 8H |
| DUSK TO DAWN | dd |
| OUTLET OVERLOAD | ER |

| TIMER SETTING: | DISPLAY WILL READ: |
|---|---|
| ALWAYS ON-STEADY ILLUMINATION | AO |
| OFF | OF |
| DUSK-ON FOR 2 HOURS | 2H |
| DUSK-ON FOR 4 HOURS | 4H |
| DUSK-ON FOR 6 HOURS | 6H |
| DUSK-ON FOR 8 HOURS | 8H |
| DUSK TO DAWN | dd |
| OUTLET OVERLOAD | ER |

| SHOW NUMBER | SHOW DESCRIPTION |
|---|---|
| 01 | STEADY ON<br>Steady On (no effects) |
| 02 | CASCADING FLASH/FADE ON<br>Progressive/3 Flashes and Fade On/Chase Up |
| 03 | FLASH/FADE ON<br>Progressive 8 Flashes/Progressive Fade On/Flash Twice/Down to Steady On |
| 04 | FADE UP AND DOWN<br>Progressive Fades On/Steady On/Regressive Fades Off to Total Off |
| 05 | MEDIUM SPEED FADE ON<br>Progressive Med. Speed Fade On/Cycles Twice/Steady On |
| 06 | SLOW FADE ON<br>Progressive Slow Fade On/Off/Steady On |
| 07 | RANDOM FLASHING AND FADING<br>Random Flash/Random Fade On in Random Sequence (ideal for Halloween Decorating) |
| 08 | VARIABLE CHASING<br>Progressive Slow Chase/Speeds Into Fast Chase Up/Regressive Chase/Sequence Chase Up/ Sequence Chase Down/Progressive Chase/Regressive Chase |
| 09 | CASCADE CHASING<br>Progressive Medium Speed Chase Up –9 cycles |
| 10 | CASCADE CHASING UP AND DOWN<br>Progressive Medium Speed Chase Up/Progressive Medium Speed Chase Down |
| 11 | FAST CHASING<br>Progressive Fast Chase |
| 12 | CASCADING FADE ON/FADE OFF<br>Progressive Fade On To Steady On/Progressive Fade On to Off |
| 13 | 3 X 2 CASCADING FADE ON/FADE OFF<br>Outlets 1&2, 3&4, and 5&6 in tandem – Fade On To Steady On/Progressive Fade Off to Off/Cycles |

FIG.4A

14 CASCADE ON/STEADY ON/CASCADE FADE OFF
Progressive Slow Chase to Steady On/Regressive Slow Chase to Off/2 Cycles 15 CASCADING FADE ON/STEADY ON/CASCADE FADE OFF
Progressive Fade to Steady On/Regressive Fade to Off/1 Cycle 16 RANDOM FLASH
Random Sequence of Slow Flash to Fast Flash 17 3 X 2 CHASING
Outlets 1&2, 3&4, and 5&6 Progressive Chase in Tandem 18 4 OUTLETS FADE UP & DOWN (OUTLETS 5 AND 6 STEADY ON)
Outlet 1 thru 4 Progressive Fade On to Steady On in Tandem/Progressive Fade to Off
Outlets 5&6 are Steady On Function (ideal for using animated lighting or chasing lights – these outlets will not interfere with the functions of lights using their own control boxes or motors)

19 ALL PROGRAMS 01–18 IN SEQUENCE
All SHOWs play in Sequence – Starting 02 Up to 18 for maximum presentation of effects

FIG.4B

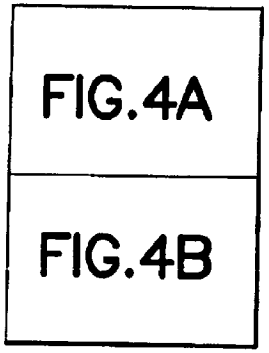

FIG.4

CONTROLLER FOR A LIGHT DISPLAY

RELATED APPLICATIONS

This application claims priority from U.S. Provisional Patent Application Ser. No. 60/417,740 which was filed on Oct. 10, 2002.

BACKGROUND OF THE INVENTION

1. Field of the Invention

The present application relates to a controller for controlling a lighting display including strings of decorative lights such as holiday lights.

2. Description of the Related Art

Decorative light strings are used as decorations inside and outside of residences, stores, and other commercial establishments, especially during various holidays and/or seasons such as Christmas and Halloween. Elaborate displays typically include more than one section or string of lights, each section of the display being separately plugged into a power outlet. Each section of lights may include two or more smaller sections or strings of lights connected in series. To enhance the display, a controller may be attached to each section such that the individual lights of that section are turned on and off in a sequence to create blinking, chasing, or random effects. Accordingly, each individual section displays a pattern of illumination. However, the sections are typically not synchronized with each other. The resultant overall display, while striking, may appear unorganized and chaotic which is undesirable.

SUMMARY OF THE INVENTION

The object of the present invention is to provide a controller for synchronizing various sections of a decorative lighting display to provide organized patterns of illumination.

According to the present invention, a controller for controlling the illumination of a plurality of decorative light strings of a lighting display includes a plurality of output ports, each being connectable to a power plug of one of the decorative light strings of the lighting display. In addition, a controller circuit is operatively connected to the plural output ports to selectively provide operating power to the plural output ports for illuminating each of the plural light strings which are connectable to the plural output ports according to programmed patterns. At least two of the power output ports are selectively provided with operating power according to at least two different programmed patterns. The illumination level of the lights may vary between a full brightness level and an "off" or no brightness level.

The different patterns preferably start and stop synchronously. Each of the output ports may receive a different programmed pattern of operative power.

The controller thus allows the various decorative strings connected to the output port to be illuminated in an organized manner. While the main intended use of the present invention is to enhance decorative holiday and seasonal lighting displays, the present invention may also be used in decorative lighting for year round displays at commercial establishments such as store front displays.

The patterns may be stored in a memory device of the controller. The controller may further include a user input device, such as buttons or keys on the controller or on a remote control device, allowing user selection of a pattern from the stored programmed patterns. Alternatively, the microprocessor may randomly assign the patterns from the memory device.

The controller may further include a dusk detecting device having a sensor responsive to an amount of light incident thereon. The sensor may be used to turn on the controller device each evening. A timing device may also be used for keeping the controller circuit on for a desired time period, which may be user selected.

A plurality of power controllers are connected to the controller for selectively providing operating power to respective ones of the plural output ports. A "show" includes a group of sequentially arranged patterns for the respective plural output ports which are applied to the respective output ports simultaneously. The memory device of the controller may store a plurality of shows, each of the shows containing different programmed patterns for each of the plural output ports. The shows may be user selectable or randomly assigned. Regardless of how they are chosen, the programmed patterns of each show start and end synchronously.

The controller is connectable to an input AC voltage supply and each of the programmed patterns is timed relative to the frequency of the input AC voltage supply. A manually operable reset device is connected to the controller for restarting a time period of each of said programmed patterns for synchronizing the controller with other controllers.

The controller may also be automatically synchronized with other controllers. This is accomplished as a result of the multiple controllers operating off of a common AC voltage source (e.g. a 60 Hz power source used in most homes in the United States). Thus, if two or more controllers are connected to a common periodic power supply, and if both controllers are powered-up simultaneously, the "shows" performed by each controller will remain synchronous with the power supply signal. This will result in the appearance that the "shows" performed by a first controller is synchronous with the "shows" performed by a second (and third, etc.) controller.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views:

FIGS. 4, 4A, 4B are tables showing various "shows" which may be selected;

DETAILED DESCRIPTION OF THE PRESENTLY PREFERRED EMBODIMENTS

Figures 1, 3:
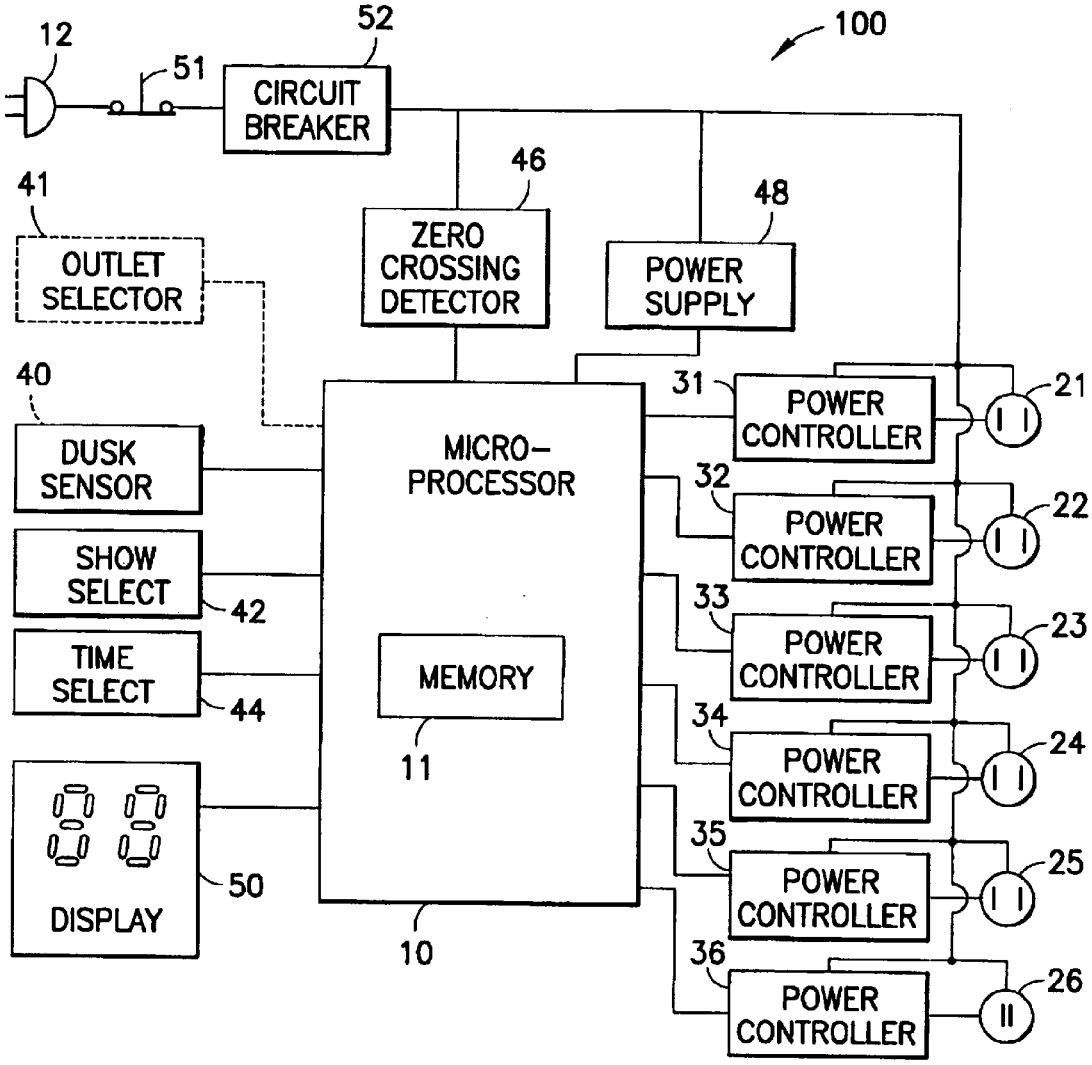
FIG. 1 is a block diagram of a controller device according to an embodiment of the present invention.
FIG. 3 is a table showing the various timer settings which may be selected.
Figure 2A:
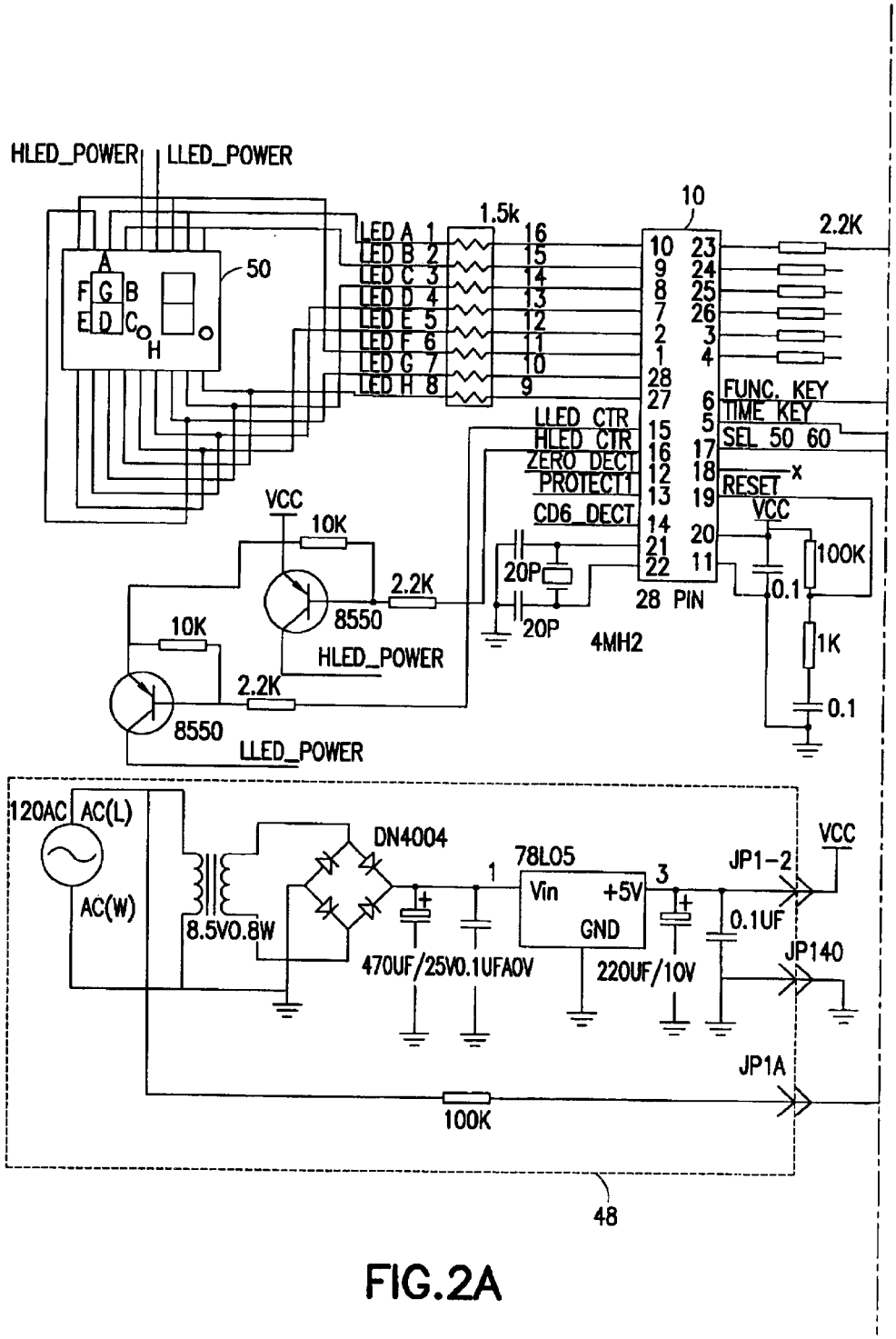
FIGS. 2, 2A, 2B are schematic diagrams of the controller device shown in FIG. 1.
Figures 2, 2A, 2B:
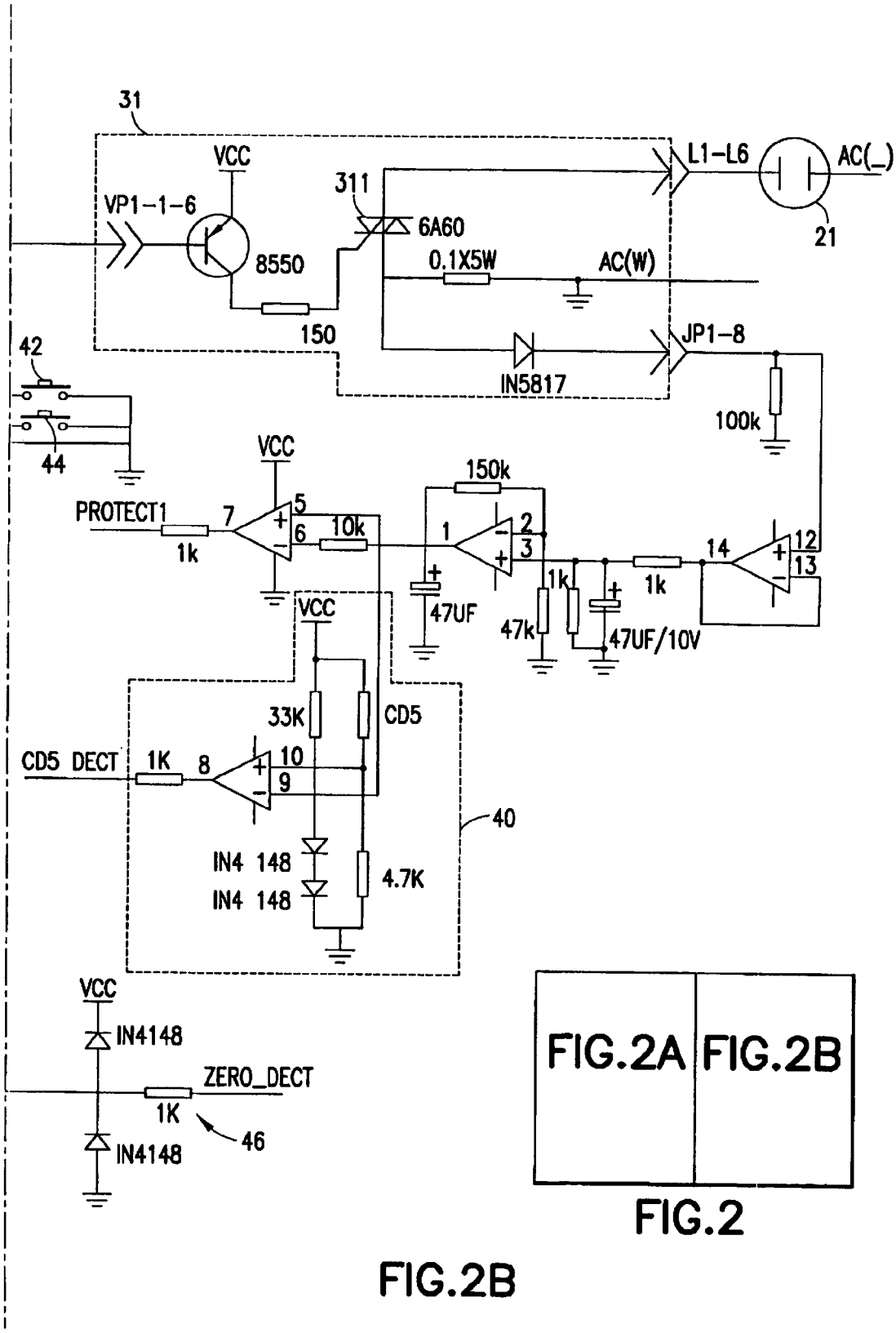
Figure 5:
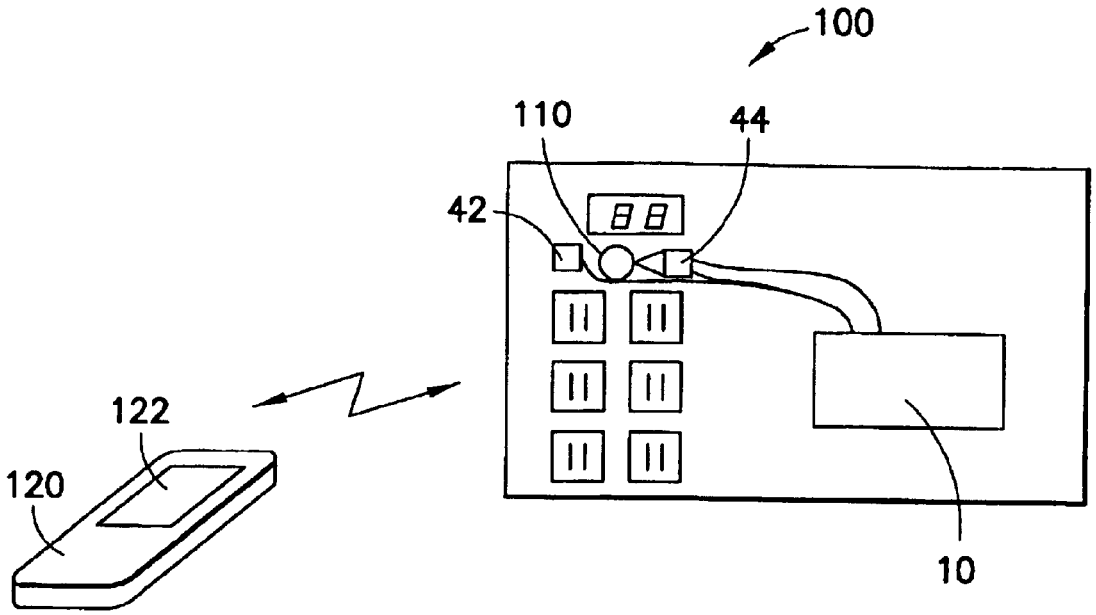
FIG. 5 is a block diagram showing a further embodiment of the controller device of FIG. 1.

FIGS. 1 and 2 show the various parts of a controller device 100 according to the present invention. The controller device 100 is plugged into a standard 120 VAC–60 Hz outlet, i.e., a standard U.S. household or residential outlet, by a plug 12. The plug is connected to a microprocessor 10 and a plurality of output ports 21–26 (also referred to as "outlets"). Each of the output ports 21–26 is connected to an associated power control unit 31–36. Decorative light strings (not shown in FIG. 1) may be plugged into the output ports 21–26. The power control units 31–36 selectively provide operative power to the output ports 21–26 in response to signals from the microprocessor 10 for selectively illuminating the decorative lights according to a pattern generated by the microprocessor 10 as described below. The illumination of the decorative lights may include illumination at a level ranging from full brightness to total darkness. Although the embodiment disclosed in FIG. 1 includes six output ports 21–26, the device 100 may include any number of output ports including two or more output ports.

A zero crossing detector 46 is arranged between the microprocessor 10 and the plug 12 and may be used as a timer as described below. Furthermore, a DC power supply 48 connected the plug 12 may be included for providing DC operating power to the microprocessor 10 such as when an AC power source is unavailable. A circuit breaker 52 may be used to protect the controller device 100 from voltage spikes that may be present on the AC power line. A reset button 51 is also provided for resetting the controller device 100 as described below.

The microprocessor 10 is also connected to a dusk sensor 40, a show selector 42, a time selector 44, and a display 50. The dusk sensor 40 includes a photocell which outputs a signal that varies in response to light incident on the photocell. More specifically, the photocell has a resistance which decreases as the amount of light to which it is exposed. Accordingly, if the controller is exposed to daylight, the dusk sensor 40 has a small resistance during the day and a larger resistance at night. The microprocessor 10 determines the onset of dusk by monitoring the resistance and determining when the resistance increases above a threshold level. The microprocessor 10 may then automatically turn on the display connected thereto upon the detection of a dusk condition. The dusk time selector 44 may be used to turn on the device for a specific amount of time after dusk is detected. The dusk time selector may comprise a button which is depressed to alter the amount of time that the controller device 100 is on. For example, a memory 11 of the microprocessor may store a plurality of time settings. Depressing the time set button once will show the current setting and pressing the time set button again will change the time setting incrementally to the next setting in the memory 11. Instead of being arranged as part of the microprocessor, the memory 11 may also be external to the microprocessor 10. FIG. 2 is a table showing, by way of non-limiting example, a list of various time settings which may be used. The show selector 42 may comprise a show set button used to select from various shows in the memory 11.

As used herein the term "show" means a group of patterns that are simultaneously applied to the respective output ports 21–26. For example, one show may consist of applying a first pattern to output port 21 (e.g., simultaneous dimming of all lights in a first light string connected to output port 21), while applying a second pattern to output port 22 (e.g., simultaneous blinking of all lights in a second light string connected to output port 22), while applying a third pattern to output port 23 (e.g., simultaneously fading all lights in a third light string connected to output port 23), etc. Instead of user-selection of the show, the microprocessor may randomly assign shows to the various output ports 21–26. FIG. 3 is a table listing, by way of non-limiting example, various show descriptions which may be used. The following is a glossary of terms used in FIG. 3.

Steady On—All output ports are on, functioning in tandem, illumination is constant with no special effects.

In Tandem—Output ports are on at the same time, outlets are performing the same function simultaneously.

Fade On—Power to the output ports gradually turns on, i.e., illumination level increases from minimum to maximum.

Fade Off—Power to the output ports gradually turns off, i.e., illumination level decreases from maximum to minimum.

Chase—Only one outlet port is powered at one time.

Progressive—Outlet ports are powered from 21–26, accumulating total outlets powers as they are successively powered, i.e., power outlet port 21 at level X, then power outlet port 22 at level 2X, then power outlet port 23 at level 3X, etc.

Regressive—Outlet ports start at full power, one outlet powered off at a time.

Progressive Cascade—Outlet ports increasing in power from none through all six.

Regressive Cascade—Outlet ports decreasing in power from all six to none.

Up—Outlet ports 21 to 26 powered in sequence with no accumulation of outlets, i.e., only one outlet is powered at a time.

Down—Outlet ports 26 to 21 are powered in sequence with no accumulation of outlets, i.e., one at a time.

3×2—Outlet port pairs are operated in tandem, i.e., 21 and 22 perform the same function, 23 and 24 perform the same function, and 25 and 26 perform the same function.

In the preferred embodiment, the currently selected show appears on the display 50 after the user depresses the show set button 42 a first time. When the show set button is depressed again, the microprocessor selects the next show in the memory, e.g. by scrolling, until the user reaches a desired show.

In the preferred embodiment, as explained above, each show affects all of the output ports 21–26. That is, each show includes a pattern which is simultaneously applied to each of the output ports 21–26. In an alternate embodiment, each output port 21–26 may receive a selected, or designated, or specific pattern individually applied to it. This alternate embodiment may be implemented by adding an output selector 41 (see FIG. 1) to the microprocessor 10. The output selector 41 is depressed to incrementally change the current output port to be selected. The user may then select a pattern for the currently selected output port 31–36. When the controller device 100 is first plugged in, the show and time selectors 42, 44 are set to default selections.

In yet another alternative embodiment, a more sophisticated user input device such as a keyboard may be used to construct user defined shows. The user can use the input device to indicate locations on a time line of the show in which the lights should be activated. This may be done by remote control using an infrared or other wireless communication. For example, FIG. 4 shows a remote control device comprising a Personal Digital Assistant (PDA) 120 used to input a show or power sequence to be applied to one of the output ports 21–26. The PDA 120 communicates with a transceiver 110 on the device 100. A display on the PDA 120 may be used to indicate the settings to the user. Of course other known remote control devices may be used and may be specifically designed for use with the controller 100.

Each of the patterns in a show for the outlets 21–26 are synchronized so that they start and stop at the same time. The zero detector 46 acts as a clock for timing the shows, i.e., the sequences of power delivered to the outlets 21–26. Accordingly, when a show is changed, it starts at the position in the cycle where the previous show was discontinued. Alternatively, the controller device 100 may start at the beginning of a show each time the user selects a new show. Instead of the zero detector 46, other electronic clocks may also be used.

As shown in FIG. 2, the power controller 31 includes a switch 311 controlled by the microprocessor 10. More specifically, the switch 311 is a semiconductor switch such as, for example, a triac which is controlled by a control signal from the microprocessor 10. Accordingly, the shows in the memory include the control signals required to switch the semiconductor switch 311 to produce the desired sequence of operative power to the outlets 21–26 to illuminate decorative lights connected thereto. The switch shown in the drawings allows continuous adjustment of the output voltage such that the illumination level of the light strings may be faded in and out between zero and full illumination. However, other switches which merely turn the light strings on and off in response to an electrical signal may also be used such as, for example, relays.

Figure 6:
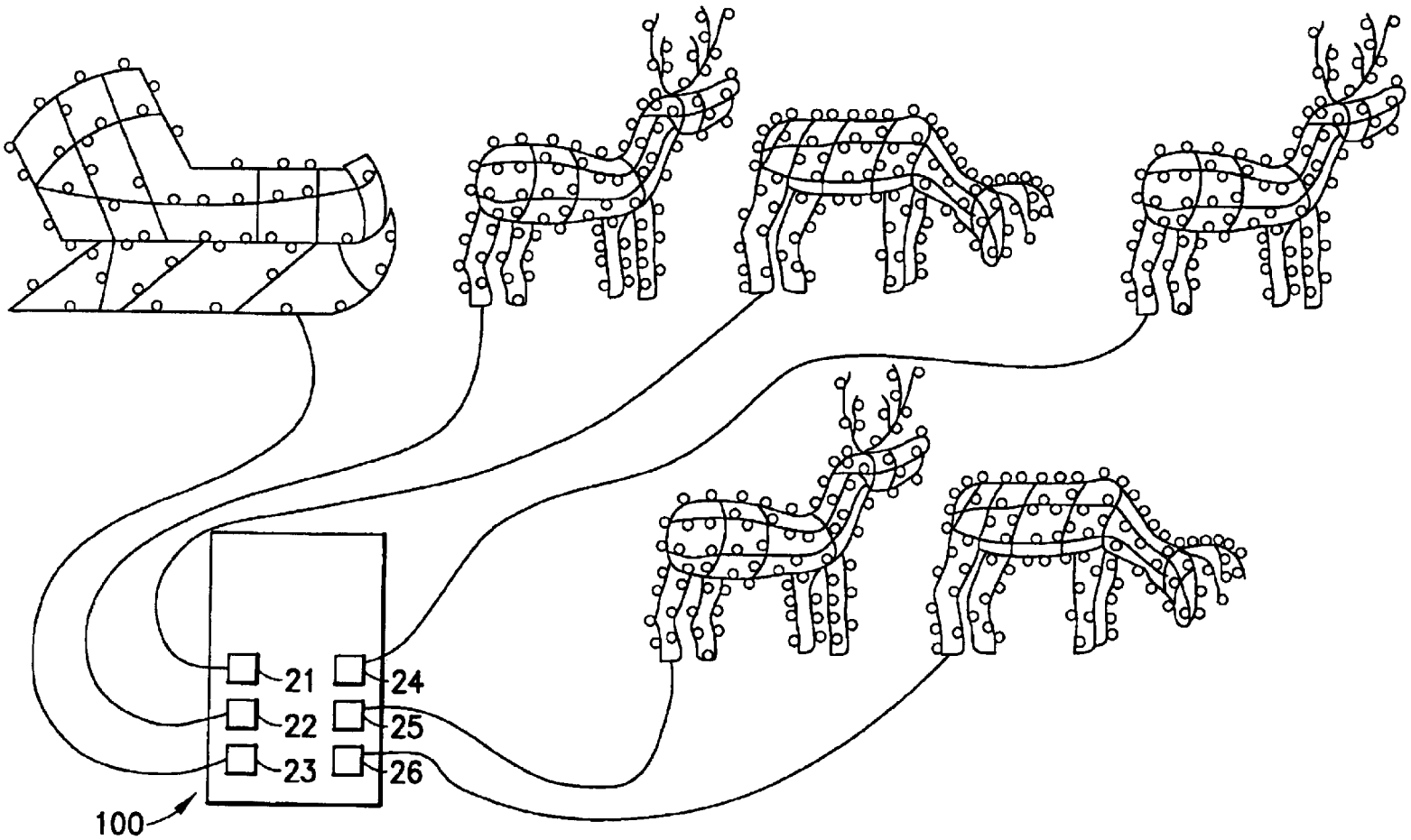
FIG. 6 is a schematic diagram showing decorative light strings connected to the controller of FIG. 1.

FIG. 6 is an example of six different decorative light strings 61–66 connected to the six different output ports 21–26 of the controller device 100. The light strings shown are arranged on frames in the shape of a sleigh and deer which are designed to be placed on a lawn. However, the light strings may also include loose strings which are typically strung along window and door frames.

When it is desired to construct a display which exceeds six decorative lights strings, multiple controller devices 100 may be used. Since each controller uses the zero crossing of the AC power supply to time the power sequences applied to the outlets, the multiple devices may be synchronized with each other as follows. The reset buttons 51 of each controller device 100 can be depressed and let go simultaneously. This will start the clock of each controller device 100 at the same time, thereby synchronizing the multiple devices. Thus, the multiple controllers will operate synchronously with each other because a common AC power line is used to power the controllers. After synchronization using this technique, the desired shows may then be selected on each of the control devices as described above.

Figure 7:
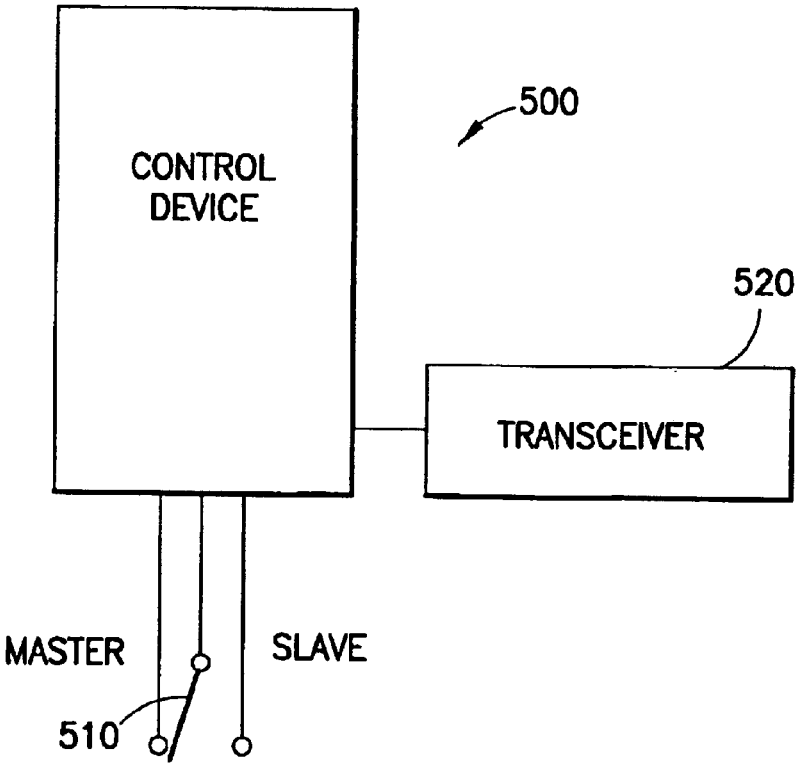
FIG. 7 is a partial block diagram showing a feature of a further embodiment of the present invention.

In an alternate embodiment according to FIG. 7, the controller devices 500 may include all of the components shown in FIG. 1 (not shown in FIG. 7) and further include a master/slave switch 510 and a transceiver device 520. When the switch 510 is in the master position, the clock of the microcontroller is connected to the remainder of the circuit and to the transceiver 520. When the switch 510 is in the slave position, the microcontroller clock is disconnected from the remainder of the circuit and the portions of the circuit which require the clock signal are connected to the transceiver 520 to receive clock information form an external device. In this embodiment, if a controller 500 is used alone, it must be set to the master switch to provide proper clock functions. If multiple controllers 500 are used, one of the controllers 500 is set to the master position and the others of the controllers are set to the slave position. The slave controllers are in communication with the master controller using the transceiver devices 520 and use the clock signal of the master controller. The connection between the transceivers 520 may be a wired connection or a wireless connection such as Bluetooth or infrared connection. In this embodiment, manual synchronization is not required.

The following is a description of the exemplary usage of the controller device of the present invention. It should be understood by a person of ordinary skill in the art that the following description is provided as an illustrative and non-limiting example. A user plugs the controller device 100 into an outlet and plugs decorative light strings into the outlet ports 21–26 of the controller device 100. The user selects the time period of desired operation using the time selector 44 and the desired shows for each of the outlet ports 21–26 using the show selector 42. The controller will now automatically control the display until the user unplugs the controller device 100.

If multiple controller devices are used, the user synchronizes each of the controllers with each other as explained above. This can occur before or after the individual light strings are connected the controllers. If the embodiment in FIG. 7 is used, one of the controller devices is selected as the master and the others are slaves.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A controller for controlling the illumination of a plurality of decorative light strings in a lighting display, said controller comprising:

a plurality of output ports, each being connectable to a power plug of one of the decorative light strings of the lighting display;

a controller circuit operatively connected to said plural output ports for selectively providing operating power to the plural output ports for illuminating the light strings connectable to said plural output ports according to programmed patterns executed by said controller circuit wherein at least two of the power output ports are respectively provided with operating power according to different programmed patterns;

a dusk detecting device having an output that changes in response to detection of incident light and;

means for turning on said controller circuit in response to said dusk detecting device.

2. The controller of claim 1, wherein said two different patterns start and end synchronously.

3. The controller of claim 2, wherein said controller device is connectable to an input AC voltage supply and each of said programmed patterns is timed relative to the frequency of the input AC voltage supply.

4. The controller of claim 3, further comprising a manually operable reset device for restarting a time period of each of said programmed patterns for synchronizing said controller with other controllers.

5. The controller of claim 2, wherein said controller comprises means for automatic synchronization with other controllers.

6. The controller of claim 1, wherein each of the output ports receives a different programmed pattern of operative power.

7. The controller of claim 1, further comprising a memory device containing a plurality of patterns.

8. The controller of claim 7, wherein said different programmed patterns are user selectable from said memory device.

9. The controller of claim 8, further comprising a user input device for selecting said different programmed patterns.

10. The controller of claim 9, wherein said user input device comprises buttons on said controller.

11. The controller of claim 9, wherein said user input device comprises a remote control device.

12. The controller of claim 7, wherein said different programmed patterns are randomly assigned from said memory device.

13. The controller of claim 1, wherein said means for turning on said control circuit comprises a timing device for keeping the controller circuit on for a desired time period.

14. The controller of claim 13, further comprising a user input device for selecting said desired time period.

15. A controller for controlling the illumination of a plurality of decorative light strings in a lighting display, said controller comprising:

a plurality of output ports, each being connectable to a power plug of one of the decorative light strings of the lighting display;

a controller circuit operatively connected to said plural output ports for selectively providing operating power to the plural output ports for illuminating the light strings connectable to said plural output ports according to programmed patterns executed by said controller circuit wherein at least two of the power output ports are respectively provided with operating power according to different programmed patterns;

wherein said controller circuit comprises a plurality of power controllers selectively providing operating power to respective ones of said plural output ports according to a show which defines a pattern for each of said plural output ports and comprises said different programmed patterns.

16. The controller of claim 15, further comprising a memory device containing a plurality of shows, each show containing different programmed patterns for each of said plural output ports.

17. The controller of claim 15, wherein said shows are user selectable from said memory device.

18. The controller of claim 17, further comprising a user input device for selecting said shows.

19. A controller system for controlling the illumination of a plurality of decorative light strings in a lighting display, said controller comprising:

a plurality of controller devices, wherein each of said controller devices includes a plurality of output ports, each of said output ports being connectable to a power plug of one of the decorative light strings of the lighting display, and a controller circuit operatively connected to said plural output ports for selectively providing operating power to the plural output ports for illuminating the light strings connectable to said plural output ports according to programmed patterns, and wherein said controller devices are connectable to an input AC voltage supply and each of said programmed patterns is timed relative to the frequency of the input AC voltage supply such that said plural controller devices are synchronized by the frequency of said input AC voltage supply.

20. The controller system of claim 19, wherein each of said control devices comprises a reset button actuatable for starting the running of the programmed patterns, thereby allowing synchronization of programmed patterns in different ones of said plural controller devices by simultaneous actuation of said reset buttons of said different ones of said plural controller devices.

21. The controller system of claim 19, wherein each of said controllers comprises means for automatically synchronizing with the others of said controllers.

22. The controller system of claim 21, wherein each of said controllers comprises means for communicating timing information between the others of said controller.

23. The controller system of claim 19, wherein said controller circuit of each of said controller devices comprises a plurality of power controllers selectively providing operating power to respective ones of said plural output ports according to a show which defines a pattern for each of said plural output ports.

24. The controller system of claim 23, wherein each of said controller devices further comprises a memory device containing a plurality of shows, each show containing different programmed patterns for each of said plural output ports.

25. The controller system of claim 24, wherein said shows are user selectable from said memory device.

26. The controller system of claim 25, further comprising a user input device for selecting said shows.

27. The controller system of claim 26, wherein said user input comprises buttons on said controller devices.

* * * * *